US006415538B1

(12) United States Patent
Brice

(10) Patent No.: US 6,415,538 B1
(45) Date of Patent: Jul. 9, 2002

(54) BREECH LOCKING SAFETY BRACKET FOR FLARE LAUNCHERS

(76) Inventor: William F. Brice, 6623 Bigelow St., Lakewood, CA (US) 90713

( * ) Notice: Subject to any disclaimer, the term of this patent is extended or adjusted under 35 U.S.C. 154(b) by 0 days.

(21) Appl. No.: 09/487,910

(22) Filed: Jan. 17, 2000

(51) Int. Cl.[7] ..... F41A 3/00
(52) U.S. Cl. ..... 42/44; 42/1.15
(58) Field of Search ..... 42/44, 1.15, 75.01, 42/71.01

(56) References Cited

U.S. PATENT DOCUMENTS

| | | | | | |
|---|---|---|---|---|---|
| 180,803 | A | * | 8/1876 | Spellerberg | 42/44 |
| 190,263 | A | | 5/1877 | Very | 102/346 |
| RE8,167 | E | | 4/1878 | Very | 102/346 |
| 217,115 | A | | 7/1879 | Kendall | 102/346 |
| 231,705 | A | | 8/1880 | Faure et al. | 102/346 |
| 521,202 | A | | 6/1894 | Burgess | |
| 530,467 | A | | 12/1894 | Balensiefer | 42/72 |
| 630,477 | A | | 8/1899 | Behr | 102/346 |
| 652,583 | A | | 6/1900 | Baird | |
| 784,977 | A | | 3/1905 | Bowly | 102/346 |
| 788,866 | A | | 5/1905 | Webber | |
| 1,436,534 | A | | 11/1922 | Russell et al. | |
| 1,788,443 | A | | 1/1931 | Sedgley | |
| 1,858,601 | A | | 5/1932 | Sedgley | |
| 1,947,834 | A | | 2/1934 | Driggs, Jr. et al. | 102/24 |
| 2,042,934 | A | | 6/1936 | Gill | 42/2 |
| 2,050,861 | A | | 8/1936 | Rolston | 42/1.16 |
| 2,055,020 | A | | 9/1936 | Wadsworth | 42/2 |
| 2,076,927 | A | | 4/1937 | Weber | 42/1 |
| 2,347,645 | A | * | 5/1944 | Mills | 42/44 |
| 2,351,268 | A | | 6/1944 | Jackson | 42/41 |
| 2,356,709 | A | * | 8/1944 | Smith | 42/44 |
| 2,459,687 | A | | 1/1949 | Decker | 102/37.7 |
| 3,062,144 | A | | 11/1962 | Hori et al. | 102/336 |
| 3,270,455 | A | | 9/1966 | Smernoff et al. | 42/1 |
| 3,349,707 | A | | 10/1967 | Wortley, Jr. et al. | 102/37.6 |
| 3,485,169 | A | | 12/1969 | Lai | 102/336 |
| 3,611,935 | A | | 10/1971 | Beckes et al. | 102/37.7 |
| 3,619,930 | A | | 11/1971 | Beermann et al. | 42/69 R |
| 3,749,019 | A | | 7/1973 | Hancock et al. | 102/337 |
| 3,759,216 | A | | 9/1973 | Sanders | 116/124 |
| 3,855,930 | A | | 12/1974 | Mulich et al. | 102/34.4 |
| 3,913,482 | A | | 10/1975 | Schiessl et al. | 102/32 |
| 3,979,850 | A | | 9/1976 | Schiessl et al. | 42/71 P |
| 4,156,980 | A | * | 6/1979 | Aspenwall | 42/44 |
| 4,176,606 | A | | 12/1979 | King et al. | 102/37.4 |
| 4,266,357 | A | | 5/1981 | Greenleaf | 42/17 |
| 4,592,159 | A | | 6/1986 | Diederichs, Jr. | 42/17 |
| 4,644,930 | A | | 2/1987 | Mainhardt | 124/58 |
| 4,914,845 | A | * | 4/1990 | Reese et al. | 42/40 |
| 5,390,605 | A | | 2/1995 | Meili et al. | 102/336 |
| 5,526,751 | A | | 6/1996 | Spivey et al. | 102/341 |
| 5,631,441 | A | | 5/1997 | Briere et al. | 102/336 |
| 5,924,229 | A | | 7/1999 | Brice | 42/1.15 |

* cited by examiner

*Primary Examiner*—Michael J. Carone
*Assistant Examiner*—Denise J Buckley
(74) *Attorney, Agent, or Firm*—Stout, Uxa, Buyan & Mullins, LLP; Frank J. Uxa

(57) ABSTRACT

A bracket for securing the barrel of a flare launcher to the body of the flare launcher.

19 Claims, 2 Drawing Sheets

BREECH LOCKING SAFETY BRACKET FOR FLARE LAUNCHERS

BACKGROUND OF THE INVENTION

The present invention relates to apparatus for launching flares. More particularly, the invention is related to apparatus for manually launching flares, for example, 12 gauge flare shells, safely, effectively and reliably.

Flares are well known as signaling devices, for example, to warn of distress in emergency, to signal one's location, to provide a specific, e.g., color coded, message and the like. Various devices have been used to launch flares. These devices are often shaped similarly to hand-held pistols which include an elongate barrel and a body with a handle which depends from the barrel at a right angle or an acute angle relative to the longitudinal axis of the barrel.

The barrel of these devices is typically hingeably attached to the body to allow a flare to be loaded into the barrel. When in the above-described position, herein termed the closed position, the barrel may be rotated about the hinge to a second, open position where the angle of the longitudinal axis of the barrel is oriented to a position more aligned with the axis of the handle, allowing access to the open portion of the barrel that is proximal to the body in the closed position. A shell is inserted into the barrel and the barrel is then rotated about its hinge to the closed position, again aligning the barrel to a locked position where the handle is at a right angle or an acute angle relative to the longitudinal axis of the barrel.

A flare shell is typically comprised of tube with a primer at the base of the tube that is ignited by compression from a firing pin. The primer, for example, ignites a propellant composition to propel a flare composition outwardly from the barrel upon firing. In the closed position the primer is typically oriented to allow the firing pin in the body of the flare launcher to strike it and ignite it. The primer in turn ignites the propellant composition, which both creates pressure within the barrel to propel the flare composition out the barrel of the gun and also ignites the flare composition itself. The flare is typically fired upwards by the user and the expelled flare composition portion of the shell burns to emit a visual indicator.

Although these devices are effective to launch flares, for example, in the form of 12-gauge flare shells, they do have drawbacks. It is important that these flares be directed properly when firing. A mis-directed flare represents a safety hazard and is substantially ineffective for its intended purpose. Also, since an explosion is involved and the flare exits the barrel at a relatively high rate of speed, it was important, for example, for safety reasons, that the launching be effectively controlled to minimize mistakenly launching the flare. At the same time, the launcher should be sufficiently straightforward enough to allow a flare to be launched relatively easily.

A problem arises when a more powerful shell is used with some flare launchers. Some flare shells create more pressure during the ignition process and can thereby cause the barrel of some flare launcher to move from the closed position to an open or semi-open position during firing. This opening of the barrel position is both dangerous to the user and can cause a mis-direction of the flare.

What is needed then is a bracket that may be mounted on existing flare launchers having hingeably attached barrels to allow them to remain securely locked in the closed position.

It is therefore a object of the present invention is to provide an apparatus to securely lock a barrel of a flare launcher having a hinged barrel in the closed position.

Further objects and advantages of the invention will become apparent to one skilled in the art by reading and understanding the following detailed description and the drawings to which it refers.

SUMMARY OF THE INVENTION

The device comprises a bracket that is placed over the barrel of a flare launcher equipped with a barrel that is hingeably attached to the body of the flare launcher. The bracket secures the barrel of the flare launcher in a closed position by anchoring one or both ends of the bracket to the body of the flare launcher.

The ends of the bracket may be provided with tabs or portions that are sized to hook on or interfere with protruberances found on the body of the flare launcher. The portions may be in the form of grooves in the bracket adapted to receive protruberances on the body of the flare launcher.

Such a flare launcher, for example a flare launcher with a typical pistol configuration, may be either in a closed position, where the angle of the longitudinal axis of the barrel is oriented to a position substantially perpendicular to the handle of the flare launcher, or, in an open position, for example where the angle of the longitudinal axis of the barrel is oriented to a position more aligned with the handle. The present invention, for example, wraps around the barrel of the flare launcher and one or both of the ends are anchored to the body when the flare launcher is in the closed position, securing the barrel in the closed position.

In the preferred embodiment the bracket is made of semicircular piece of stainless spring steel and is sized to closely conform to the shape of the circumference of the barrel. The flare launcher is placed in the open position and the bracket is slid along the length of the barrel from the end of the barrel proximal the body when it is in the closed position, towards the end of the barrel distal the body when it is in the closed position.

The flare launcher thereafter may be loaded with a flare and then placed in the closed position. After the flare launcher is placed in the closed position the bracket is slid along the barrel towards the body of the flare launcher to where the tabs or portions of the bracket engage any protrubernace in the body. The bracket also exerts a spring tension force on both the barrel and the body of the flare launcher to further ensure that the two portions are secured in relation to each other.

Accordingly, although an exemplary embodiment of the invention is shown and described, it is to be understood that all the terms used herein are descriptive rather than limiting, and that many changes, modifications, and substitutions may be made by one having ordinary skill in the art without departing from the spirit and scope of the invention.

Any and all features described herein and combinations of such features are included within the scope of the present invention provided that the features of any such combinations are not mutually inconsistent.

DETAILED DESCRIPTION OF THE INVENTION

The following detailed description, and the figures to which it refers, are provided for the purpose of describing an example and specific embodiment of the invention only and are not intended to exhaustively describe all possible examples and embodiments of the invention. In the following description various figures having identical elements and features are given the same reference number, and similar or corresponding elements and features are given the same reference numbers followed by an a, b, c, and so on as appropriate for purposes of describing the various aspects of the present invention.

Figure 1:
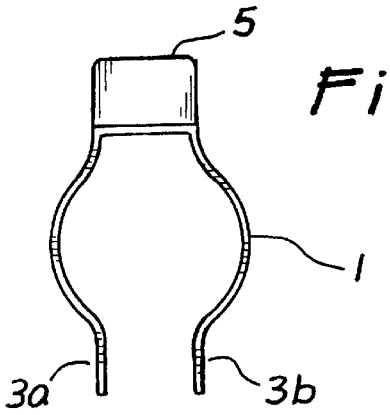
FIG. 1 is a end view of an embodiment of the bracket of the present invention.
Figure 2:
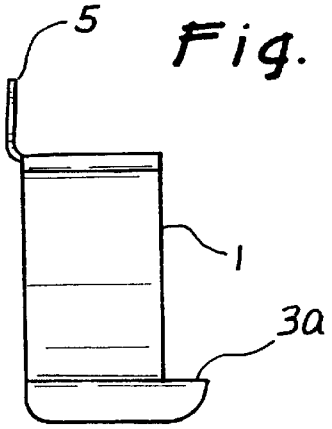
FIG. 2 is a side view of an embodiment of the bracket of the present invention. p

Referring now to FIG. 1 there is shown a bracket 1 formed to closely fit around a circular member, near the barrel of a flare launcher. FIG. 2 shows the same bracket 1 from a side view showing where end tabs 3*a* and 3*b* (FIG. 1) extend outwardly from the plane of the bracket. A grasping tab 5 is provided for grasping the bracket when placing and moving it on the barrel of a flare launcher.

By way of example a typical flare launcher, such as 12-gauge Alerter® model flare launcher manufactured by the Orion company of Peru, Ind., is used to illustrate the operation of the invention.

Figure 3:
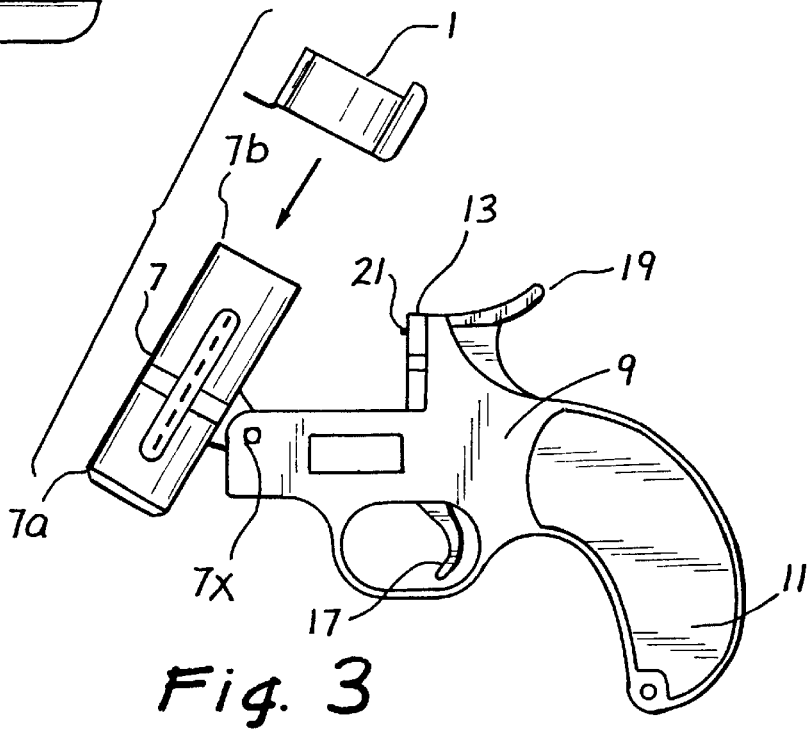
FIG. 3 is an elevation view of an embodiment of the bracket of the present invention being placed on a typical flare launcher.
Figure 6:
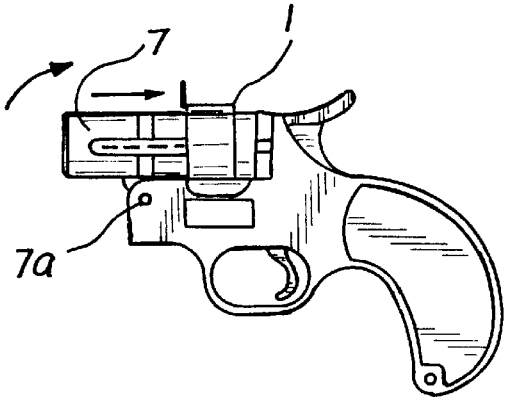
FIG. 6 is an elevation view of an embodiment of the bracket of the present invention placed on a typical flare launcher.
Figure 7:
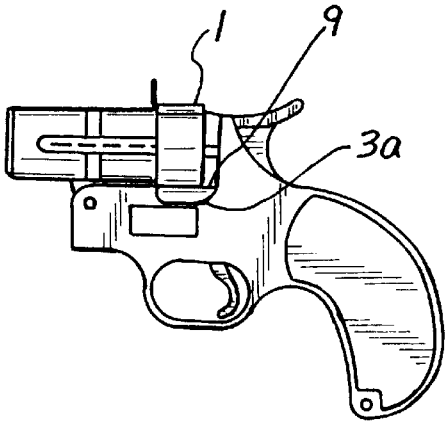
FIG. 7 is an elevation view of an embodiment of the bracket of the present invention placed on a typical flare launcher.

Referring now to FIG. 3, a flare launcher, such as the Alerter® flare launcher, is shaped similarly to a hand-held pistol and includes an elongate barrel 7 and a body 9 having a handle 11 which depends from the barrel at a right angle or an acute angle relative to the longitudinal axis of the barrel when the barrel is in the closed position, as shown in FIGS. 6 and 7.

The barrel 7 of this type of flare launcher is hingeably attached to the body at hinge 7*x*, to allow the barrel to be rotated about the hinge and to expose the end of the barrel to allow a flare to be loaded into the barrel. The barrel has an outer surface and at least two ends, an end distal the body of the flare launcher when in the closed position 7*a*, and an end proximal to the body of the flare launcher when in the closed position 7*b*. The barrel is rotated about the hinge 7*x* to an open position, shown in FIGS. 3 and 5, where the angle of the longitudinal axis of the barrel is oriented to a position more aligned with the handle, allowing access to the open portion of the barrel 7 that is proximal to the body in when the barrel is placed in the closed position.

Figure 4:
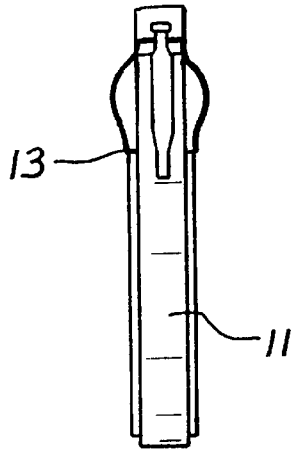
FIG. 4 is an end view of an exemplary flare launcher.

An arrow in FIG. 3 shows the direction in which the bracket 1 is inserted over the barrel when it is in the open position. By way of example, the flare launcher has a back plate 13 where the barrel abuts the body of the flare launcher, and the back plate protrudes radially from the sides of the flare launcher, which is more clearly shown in FIG. 4. The backplate is an illustrative example of a protrusion on the body of the flare launcher that the bracket of the present invention uses to anchor the barrel to the body of the flare launcher. The backplate extends outwardly from the body of the flare launcher, as will any protrusion on the body of the flare laucher.

The flare launcher shown in FIG. 3 additionally includes a trigger 17 that actuates a hammer 19 in a manner well known in the art to cause a firing pin 21 to strike a 12-gauge flare shell.

It should be noted that although reference has been made to a 12-gauge shell, this is for illustrative purposes only and the actual caliber of the flare is not critical to the present invention.

Figure 5:
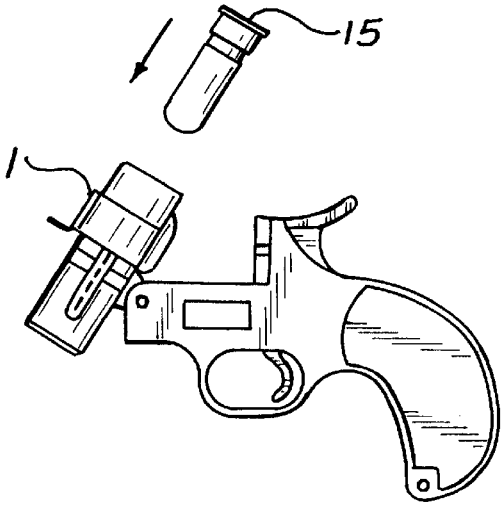
FIG. 5 is an elevation view of an embodiment of the bracket of the present invention placed on a typical flare launcher.

FIG. 5 shows the bracket 1 moved to a position away from the end of the barrel that is proximal to the body of the flare launcher when in a closed position. A flare shell 15 is inserted into the barrel (indicated by arrow).

FIG. 6 shows the flare launcher in the closed position, where the barrel 7 is then rotated about its hinge 7*x* to a closed position, in the direction of the curved arrow, again aligning the barrel to a closed position where the handle 11 is at a right angle or an acute angle relative to the longitudinal axis of the barrel. The bracket 1 of the present invention is then moved along the barrel towards the body of the flare launcher, as indicated by the arrow.

As shown in FIG. 7, bracket 1 is moved until tab 3*a* and 3*b* (not shown) are slid under protruding backplate 9, securing the barrel in the closed position because tabs 3*a* and 3*b* will interfere with backplate 9 if force is exerted to move the barrel to the open position.

FIG. 7 shows the flare launcher configured to fire the flare. The user aims the flare launcher, usually in an upward direction, and pulls the trigger 17 in FIG. 3, causing the firing pin 21 mounted on the hammer 19, both in FIG. 3, to strike the primer of the flare and the flare ignites and is launched.

In a preferred embodiment the bracket is made from flexible stainless spring steel that is sized to exert spring tension on the barrel and body of the flare launcher. This spring tension prevents the bracket from moving during use.

An alternative method of affixing the bracket to the flare launcher without moving the flare launcher between open and closed positions is possible. While in the closed position the bracket may be slid over the barrel at the end distal the body when in the closed position, until it is in a position on the barrel between the hinge and the body, and the tabs or portions interfere with a protrusion on the body.

Other methods of placing the bracket on the barrel of the flare launcher are possible, but to secure the barrel to the body such methods preferably result in the bracket being placed on the barrel between the hinge and the body, and the tabs or portions interfere with one or more protrusions on the body.

Another alternative embodiment of the present invention is a configuration of the bracket that may be manually installed the flare launcher without the use of tools. Another alternative embodiment of the present invention is a configuration of the bracket that may be manually removed from the flare launcher without the use of tools.

It will be appreciated that the invention is described herein with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. An apparatus for securing the position of a flare launcher wherein the flare launcher includes a barrel and a body pivotally attached thereto, the barrel being movable between an open position for loading a flare and a closed position for launching the flare, the apparatus comprising:

a bracket structured and adapted to be removably secured to the flare launcher, the bracket including a clamp portion adapted to slidably engage the flare launcher, and an extended portion extending outwardly from said clamp portion such that when the clamp portion is engaged with the barrel of the flare launcher in the closed position and the extended portion is positioned to interfere with a protrusion on the body of the flare launcher, the barrel of the flare launcher is locked in the closed position.

2. The apparatus of claim 1 wherein the bracket is made of a spring material.

3. The apparatus of claim 1 wherein the bracket is made of a steel spring material.

4. The apparatus of claim 1 wherein the bracket is shaped and structured to slidably engage an outer surface of the barrel.

5. The apparatus of claim 1 wherein the bracket is structured and adapted to be manually moved along a length of the barrel of the flare launcher.

6. The apparatus of claim 5 wherein the bracket includes a movement tab to facilitate manual moving of the bracket along the length of the barrel of the flare launcher.

7. An apparatus for fixing a position of a flare launcher, wherein-the flare launcher includes a barrel and a body pivotally attached thereto and the barrel is movable between an open position for loading a flare and a closed position for launching a flare, the apparatus comprising:

a bracket adapted to removably engage the flare launcher, the bracket including a clamp portion sized to slidably engage the barrel of the flare launcher and an extended portion extending outwardly from said clamp portion, the extended portion sized and positioned to interfere with a portion of the body of the flare launcher when the barrel is in a closed position, the bracket being effective to prevent pivotal movement of the barrel with respect to the body of the flare launcher.

8. The apparatus of claim 7 wherein the bracket is made of a spring material.

9. The apparatus of claim 7 wherein the bracket is adapted to be manually moved along a length of the barrel of the flare launcher.

10. The apparatus of claim 7 wherein the bracket is shaped and structured to slidably engage an outer surface of the barrel of the flare launcher.

11. The apparatus of claim 7 wherein the bracket includes a movement tab to facilitate manual moving of the bracket along the length of the barrel of the flare launcher.

12. The apparatus of claim 7 wherein the bracket is adapted to be placed on the barrel of the flare launcher when the barrel is in the open position.

13. A flare launcher apparatus comprising:

a flare launcher comprising a barrel and a body pivotally attached to the barrel, wherein the barrel is movable between an open position for loading a flare and a closed position for launching a flare; and a bracket removably engaged to the flare launcher, the bracket including a clamp portion and an extended portion extending outwardly from said clamp portion, the extended portion sized and positioned to interfere with a portion of the body of the flare launcher when the barrel is in a closed position, the bracket being effective to prevent pivotal movement of the barrel with respect to the body of the flare launcher.

14. The apparatus of claim 13 wherein the bracket is effective to lock the barrel in the closed position.

15. The apparatus of claim 14 wherein the bracket is made of a steel spring material.

16. The apparatus of claim 14 wherein the bracket is adapted to be manually moved along a length of the barrel of the flare launcher.

17. The apparatus of claim 14 wherein the clamp portion is sized and structured to slidably engage the barrel of the flare launcher.

18. The apparatus of claim 13 wherein the bracket is adapted to be manually moved along a length of the barrel.

19. The apparatus of claim 13 wherein the bracket includes a movement tab to facilitate manual moving of the bracket along the length of the barrel of the flare launcher.

* * * * *